US007815416B2

(12) United States Patent
Mizumi et al.

(10) Patent No.: US 7,815,416 B2
(45) Date of Patent: Oct. 19, 2010

(54) STEAM TURBINE

(75) Inventors: Shunsuke Mizumi, Hitachinaka (JP); Ryuichiro Iwano, Hitachi (JP); Koji Ishibashi, Hitachi (JP); Goingwon Lee, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 693 days.

(21) Appl. No.: 11/834,239

(22) Filed: Aug. 6, 2007

(65) Prior Publication Data

US 2008/0063518 A1 Mar. 13, 2008

(30) Foreign Application Priority Data

Sep. 8, 2006 (JP) ..... 2006-243543

(51) Int. Cl.
*F01D 1/02* (2006.01)

(52) U.S. Cl. ..... 415/182.1; 415/183; 415/196; 415/198.1

(58) Field of Classification Search ..... 415/182.1, 415/183, 196, 198.1
See application file for complete search history.

(56) References Cited

U.S. PATENT DOCUMENTS 3,141,348 A * 7/1964 Dixon ..... 415/14
3,628,878 A * 12/1971 Trassel et al. ..... 415/108
4,847,039 A * 7/1989 Kendall et al. ..... 415/155

FOREIGN PATENT DOCUMENTS

JP 11-229818 8/1999

* cited by examiner

*Primary Examiner*—Igor Kershteyn
(74) *Attorney, Agent, or Firm*—Brundidge & Stanger, P.C.

(57) ABSTRACT

In a steam turbine having a cross-over duct for delivering steam discharged from an intermediate pressure turbine to low pressure turbines, the intermediate pressure turbine provides two outlets for discharging exhaust steam, the low pressure turbine provides two inlets, and the outlets and the inlets are arranged on the same straight line as viewed from a planar direction. One of the outlets and one of the inlets which are close to each other are connected through a cross-over duct, the other of the outlets and the other of the inlets which are far from each other are connected through another cross-over duct, and the cross-over ducts are arranged to be at two stages in the up-down direction.

6 Claims, 4 Drawing Sheets

FIG. 5
| VERTICAL PIPES (a,b) | BENT PIPES (a,b) | HORIZONTAL PIPE |
|---|---|---|
| "a" AND "b" ARE CYLINDRICAL AND FLAT, RESPECTIVELY, OR VICE VERSA, OR ARE CYLINDRICAL OR FLAT. | AT LEAST ONE OF "a" AND "b" IS FLAT. | CYLINDRICAL OR FLAT |
FIG. 6
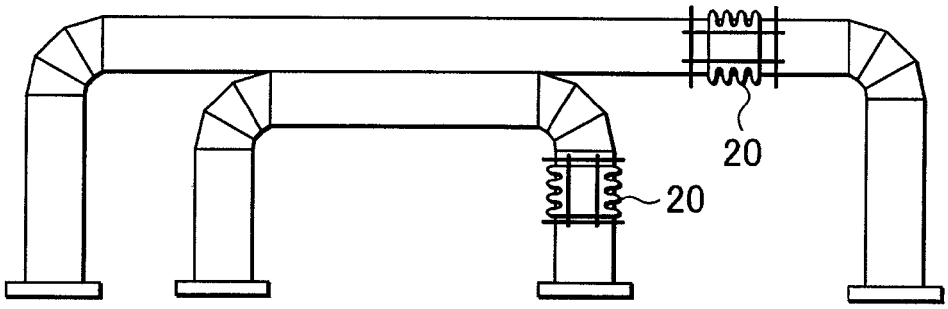
FIG. 7
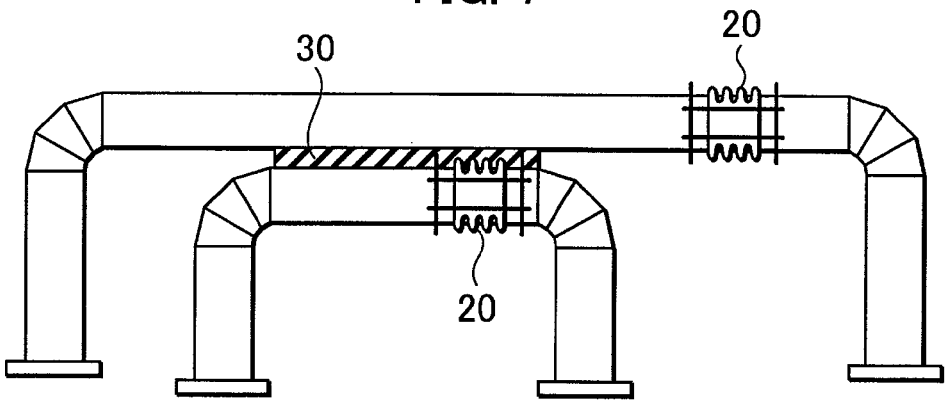

| SHAPE | | RADIUS RATIO | TOTAL LOSS COEFFICIENT |
|---|---|---|---|
| CIRCLE |  | R/a=2<br>4<br>6 | 0.246<br>0.159<br>0.152 |
| RECTANGLE (h/b=2) |  | R/(b/2)=2<br>4<br>6 | 0.227<br>0.115<br>0.121 |

STEAM TURBINE

BACKGROUND OF THE INVENTION

1. Field of the Invention

The present invention relates to a structure of a cross-over duct for a steam turbine.

2. Description of the Related Art

In a steam turbine, a connection pipe adapted to allow the steam discharged from an intermediate pressure turbine (or high pressure turbine) to flow into a low pressure turbine is generally referred to as a cross-over duct. Incidentally, examples of conventional techniques pertaining to the cross-over duct include the technique disclosed in JP-A-11-229818 (FIG. 1).

SUMMARY OF THE INVENTION

The cross-over duct is just a mere passage. A loss (pressure loss) generated inside the cross-over duct could be neglected while it was relatively smaller than a loss in the entire system including turbine blades. However, since the performance of a turbine itself is significantly enhanced nowadays, a loss in the cross-over duct cannot be neglected in order to increase power generation efficiency of the entire power plant.

Examples of portions where major losses occur in a duct with respect to flow include a portion that involves the abrupt divergent and convergent of flow and the abrupt turn of flow (a bent portion) and a portion that involves a factor disturbing flow such as merging and branch. If a duct includes branch and merging portions, a difference in pressure between two exhaust steam outlet portions of intermediate pressure turbine and a difference in pressure between two exhaust steam inlet portions of low pressure turbine are likely to occur. Therefore, flow rate balance in the turbine deviates from a design point, and it may increase an exhaust steam loss.

FIG. 3 of JP-A-11-229818 mentioned above illustrates a structure in which an exhaust steam outlet is one-on-one connected to an associated exhaust steam inlet. In cross-over ducts of this type, bent portions extend aslant to spread leftward and rightward relative to a rotor shaft instead of not extending vertically from the rotor shaft. This provides a shape that can alternately arrange two cross-over ducts having the same structure without intersecting them with the result that a loss can be reduced.

If the cross-over ducts are arranged to be separate leftward and rightward relative to the central axis of a turbine rotor, the gravity centers of the cross-over ducts are deviated from the central axis of the rotor. Since the turbine blades are rotated at very high-speed, even slight deviation of the central axis of the rotor is likely to cause a critical failure. To prevent such a failure, the above duct structure uses such a robust cross-over duct as to be less susceptible to strain or additionally needs a support assist structure. In particular, a bulk plant produces a problem with cost and reliability.

An object of the present invention is to provide a steam turbine having a cross-over duct that can reduce a pressure loss occurring therein and is structured excellently in view of strength.

To achieve the above object, the present invention provides a steam turbine having a cross-over duct for delivering steam discharged from an intermediate pressure turbine to a low pressure turbine, wherein the intermediate pressure turbine provides two outlets for discharging exhaust steam and the low pressure turbine provides two inlets, the outlets and the inlets are arranged on the same straight line as viewed from a planar direction, one of the outlets and one of the inlets which are in close position each other are connected through a cross-over duct, the other of the outlets and the other of the inlets which are in far position each other are connected through another cross-over duct, and the cross-over ducts are arranged to be at two stages in the up-down direction.

According to the present invention, it is possible to provide a steam turbine having a cross-over duct that can reduce a pressure loss occurring therein and is structured excellently in view of strength.

BRIEF DESCRIPTION OF THE DRAWINGS

FIG. 5 illustrates exemplary combinations of a flat pipe and a cylindrical pipe.

FIG. 6 illustrates an applicative example of an expansion joint (bellows).

FIG. 7 illustrates another applicative example of the expansion joint (bellows).

DETAILED DESCRIPTION OF THE PREFERRED EMBODIMENTS

In a steam turbine, a cross-over duct is adapted to allow steam discharged from an intermediate pressure turbine (or a high pressure turbine) to flow in a low pressure turbine. The basic structure of the cross-over duct includes some different types depending on the number of casings for the intermediate pressure turbine and low pressure turbine. An embodiment of the present invention describes a steam turbine in which two exhaust steam outlets are provided on an intermediate pressure turbine side, and similarly two exhaust steam inlets are provided on a low pressure turbine side, and the exhaust steam outlets and the exhaust steam inlets are located on the same straight line.

Figure 1:
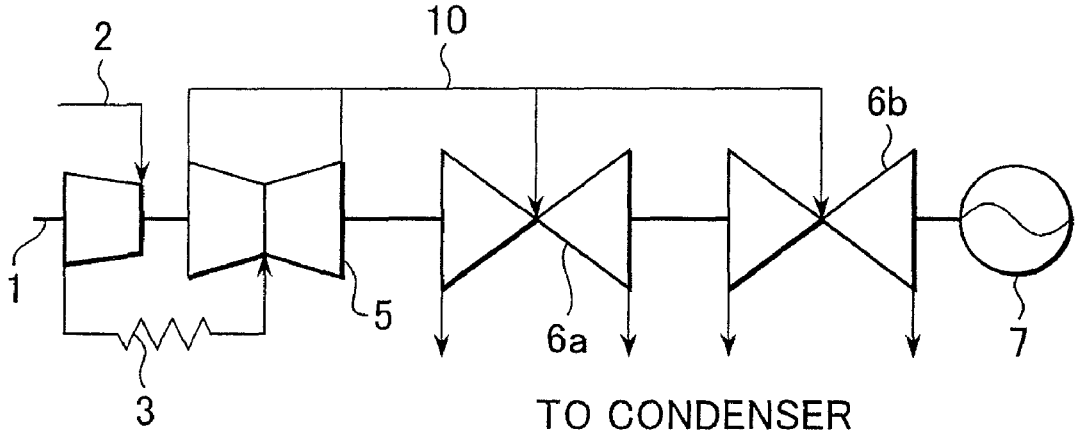
FIG. 1 is a systematic diagram of a general steam turbine.

FIG. 1 schematically shows a systematic diagram of the most general steam turbine in such a case. The shape and role of the most typical cross-over duct will be described below with reference to FIG. 1.

FIG. 1 illustrates a steam turbine of a tandem (spit-style) compound four-flow type. This steam turbine includes three constituent elements: a high pressure turbine 4, an intermediate turbine 5, and low pressure turbines 6*a*, 6*b*. A single turbine rotor 1 penetrates such turbines in a tandem manner and is coupled to a generator 7. In addition, the number of steam flow path (flows) increases as 1, 2 and 4 in the order of the high pressure turbine 4 and intermediate pressure turbine 5 and low pressure turbines 6*a*, 6*b*.

A steam flow of the steam turbine in FIG. 1 will now be described. The steam pressurized and heated in a boiler (not shown) passes through a main steam duct 2 and is delivered to the high pressure turbine 4. The steam that has performed work in the high pressure turbine 4 is re-heated in a boiler reheater 3 and then delivered to the intermediate pressure turbine 5. The intermediate pressure turbine 5 includes two left and right main flow paths. The steam that has been delivered into the intermediate pressure turbine 5 through the central portion thereof diverges into left and right and performs work in different intermediate pressure turbine sections. The steam discharged from the intermediate pressure turbine 5 passes through a cross-over duct 10 and is delivered to the lower pressure turbines 6*a*, 6*b*.

Figure 2:
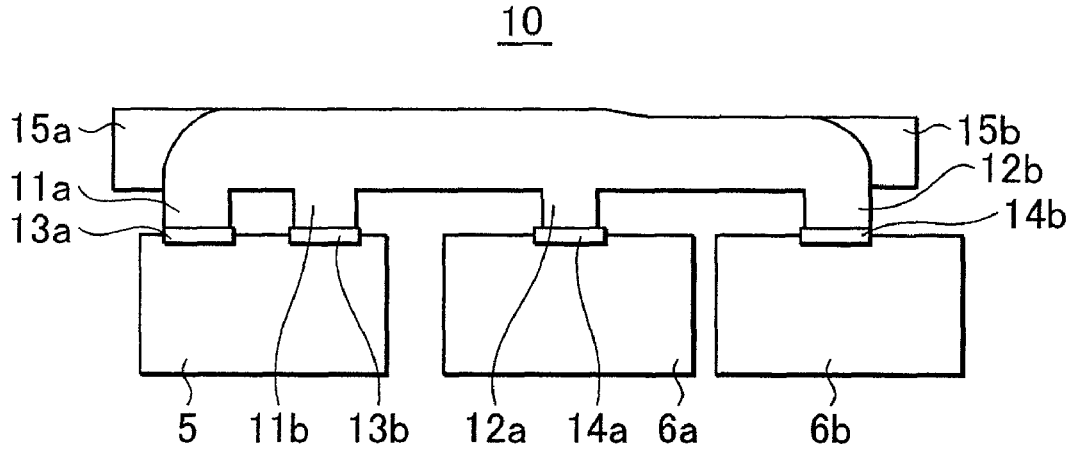
FIG. 2 is a schematic diagram of a general cross-over duct.

The cross-over duct 10 is further classified into a type that has branch and merging, and a type that does not have branch and merging. FIG. 2 illustrates a typical example of the type that has branch and merging. The steam discharged from two intermediate pressure exhaust steam chamber outlet portions 13*a*, 13*b* of the intermediate pressure turbine passes through inlet straight pipe portions 11*a*, 11*b* of cross-over duct to flow in the cross-over duct 10 and merges in a horizontal pipe as the cross-over duct main body. Then, the steam branches into two outlet straight pipe portions 12*a*, 12*b* of cross-over duct and flows downward into respective low pressure exhaust steam chamber inlet portions 14*a*, 14*b* of the low pressure turbine. Incidentally, pipes 15*a*, 15*b* joined to both end bent portions in FIG. 2 are each called a balance pipe, and small holes (balance holes) are provided at the bent portions to play a role of alleviating a steam reaction force generated due to nonuniform pressure of the axial direction of the turbine.

Figure 3A:
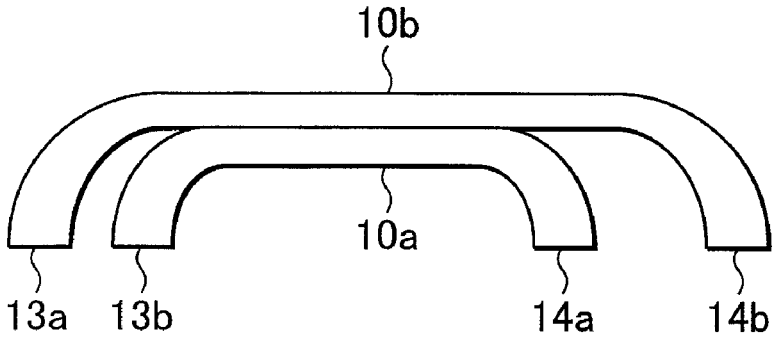
FIGS. 3A, 3B and 3C are a lateral view, a front view, and a plan view, respectively, schematically illustrating cross-over ducts according to an embodiment of the present invention.
Figure 3B:
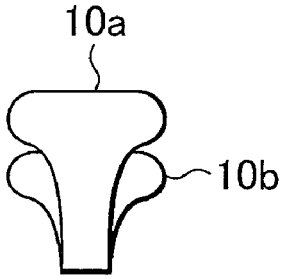
Figure 3C:
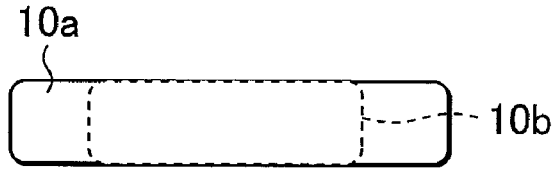

FIGS. 3A, 3B and 3C illustrate a schematic configuration of a cross-over duct according to an embodiment of the present invention. It is to be noted that FIGS. 3A, 3B and 3C illustrate only the cross-over duct extracted from the steam turbine while omitting the major portion of the steam turbine.

In the present embodiment, two intermediate pressure exhaust steam chamber outlet portion 13*a*, 13*b* and the two low pressure exhaust chamber inlet portion 14*a*, 14*b* are arranged on a straight line, and each of the outlet portions is one-on-one associated with a corresponding one of the inlet portions. In this case, one of the outlet portions and one of the inlet portions which are in close distance each other are paired and connected through a duct, the other of the outlet portions and the other of the inlet portions which are in far distance each other are paired and connected through a duct, and the ducts are arranged to be at two stages in the up-down direction. More specifically, the intermediate exhaust steam chamber outlet portion 13*a* and the low pressure exhaust steam chamber inlet portion 14*b* which are in far distance each other are connected through an upper cross-over duct 1*a*. In addition, the intermediate pressure exhaust steam chamber outlet portion 13*b* and the lower pressure exhaust steam chamber inlet portion 14*a* which are in close distance each other are connected through a lower cross-over duct 10*b*. Each of the ducts is composed of only bent portions and a straight portion, that is, is configured not to include merging and branch.

Further, the bent portions of each duct are configured to be flat. In this case, a plurality of combinations can be provided depending on which part of the duct is made flat. The combinations of a flat part and a cylindrical part will be described with reference to FIG. 4 and a table of FIG. 5.

Figure 4:
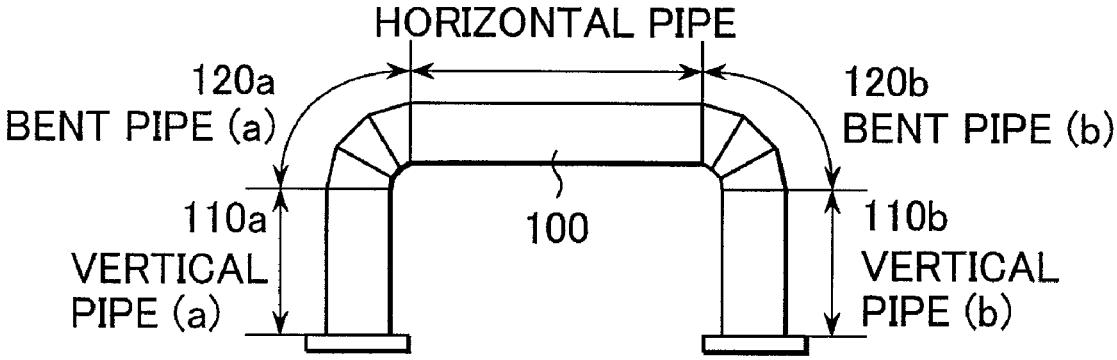
FIG. 4 is a diagram illustrating the constituent elements of one cross-over duct.

One cross-over duct of the present invention will now be described. As shown in FIG. 4, this cross-over duct basically includes two vertical pipes 110*a*, 110*b*, two bent pipes 120*a*, 120*b*, and one horizontal pipe 100. To produce an effect of reducing pressure loss by making a pipe flat, as shown in the table of FIG. 5, it is need only to make at least one bent pipe flat, and the other portions may be flat or cylindrical. Thus, the entire shape provides a large number of combinations. The embodiment illustrated in the figure corresponds to an example in which the horizontal pipe 100 and the two bent pipes 120*a*, 120*b* are made flat and the vertical pipes 110*a*, 110*b* are made cylindrical.

When these two ducts are arranged to be at two stages in the up-down direction, it is possible to put one of the ducts on top of the other in such a manner that the lower cross-over duct supports the upper cross-over duct.

Incidentally, while the balance pipe is omitted in the figures, a structure attached with or not attached with the balance pipe can be provided.

The cross-over duct is secured to the intermediate pressure exhaust steam chamber outlet portion of the intermediate pressure turbine casing on upstream side through which high-temperature steam flows and to the lower pressure exhaust steam chamber inlet portion of the lower pressure turbine casing on downstream side through which lower-temperature steam flows. For this reason, an expansion joint (bellows) is generally provided to absorb thermal expansion due to a relative thermal difference between both the casings (it is omitted in FIG. 3). It is generally possible to install the expansion joint (bellows) used to absorb the thermal expansion difference at any of a horizontal straight pipe portion and a vertical straight pipe portion.

FIG. 6 illustrates an installation example of the expansion joints at the cross-over ducts. In the figure, expansion joints 20 are installed at a horizontal pipe portion of the upper cross-over duct 10*a* and at a vertical pipe portion of the lower cross-over duct 10*b*.

FIG. 7 illustrates another installation example of the expansion joints. In this embodiment, expansion joints 20 are installed at respective horizontal pipe portions of both the upper and lower cross-over ducts 10*a*, 10*b*. In this case, however, the horizontal pipe portion installed with the expansion joint 20 is formed such that its outer shape partially externally protrudes. If the expansion joint 20 is installed at the part where the upper duct is put on the lower duct, it is necessary to devise the contact part between the upper and lower ducts so as to externally protrude from the expansion joint 20. In the present embodiment, a guide rail 30 is provided to straddle the expansion joint 20 at the horizontal pipe portion of the lower cross-over duct 10*b*, and the upper cross-over duct 10*a* is put on the guide rail 30. In this way, since the guide rail 30 is interposed between the upper and lower cross-over ducts 10*a*, 10*b*, the expansion joint 20 does not come into direct contact with the upper cross-over duct 10*a*. In addition, the expansion direction of the lower cross-over duct 10*b* (and the upper cross-over duct 10*a*) can constantly be oriented in a fixed direction by the guide rail 30. Therefore, the lower cross-over duct 10*b* can be maintained horizontally with respect to the upper cross-over duct 10*a* as viewed from the horizontal direction.

According to the embodiment described above, the cross-over duct is not branched or merged and does not have a portion therein where the abrupt divergent and convergent of flow occur. Therefore, a deviation in velocity or pressure is unlikely to be produced, and it can minimize a loss.

Further, the cross-sectional shape of the bent portion of the cross-over duct perpendicular to flow is made flat so as to minimize a loss caused by vortices due to a secondary flow. Consequently, a pressure loss occurring at the bent portion can be reduced.

Figure 8:
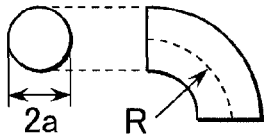
FIG. 8 is a table illustrating total loss coefficients $\xi$ of a bent pipe having a circular cross-section and total loss coefficients $\xi$ of a bent pipe having a rectangular cross-section.
Figure 8:
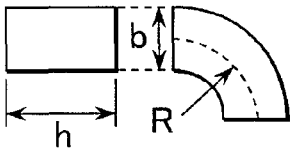

For reference, FIG. 8 shows experimental values of the total loss coefficient $\xi$ of a flat cross-section (rectangular cross-section) type bent pipe and a circular cross-section type bent pipe (partially reproduced from table 4.18 on P. 74 in the literature: technical data, fluid resistance of a pipe line/duct, Japan Society of Mechanical Engineers). In the literature, the Reynolds number is $10^6$, and the inner wall of a duct is fluidally smooth. The total loss coefficient $\xi$ is obtained by dividing the total pressure loss by dynamic pressure and defined by the following expression.

$$\xi=\Delta P/(v^2/2g)$$

In the expression, ΔP is the total pressure loss, v is current velocity, and g is a gravitational constant.

The numerical values indicate only a case where a horizontal to vertical ratio (h/b) is 2 and the direction of flow is changed by 90 degrees. Smaller numerical values generally mean better performance. This table shows if the curvature radii R of bent portions are the same, the rectangular cross-section is more advantageous than the circular cross-section.

Figure 9:
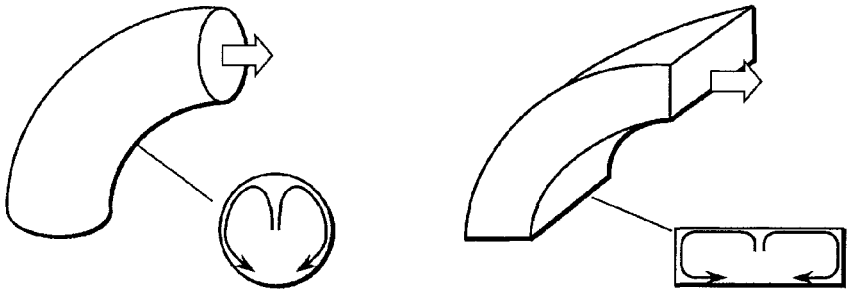
FIG. 9 is a diagram schematically illustrating an effect on the secondary flow depending on a difference in the shape of bent portion of the cross-over duct.

On the other hand, FIG. 9 illustrates the above in view of flow. The bent pipe causes a flow, called a secondary flow, perpendicular to a mainstream due to a centrifugal force. If the secondary flow component is large, a loss is increased. The flat bent pipe generally causes a smaller secondary flow component than the circular bent pipe and thus easily makes a loss small.

Incidentally, the loss at a bent pipe portion is reduced by increasing its curvature radius. A simply increased curvature radius means an increase in the height-wise size of the duct itself. Therefore, it poses a problem with the limit of crane hoist height in a turbine building and with cost. As in the present embodiment, if a bent portion is formed such that its cross-section perpendicular to a flow is made flat, e.g., in an almost rectangular shape and also a straight duct portion is made flat, it is possible to suppress the height-wise size to some extent while maintaining the increased curvature radius of the bent portion.

Further, the upper and lower flat cross-over ducts of two stages are configured so that the lower cross-over duct supports the upper cross-over duct. This makes it possible to further reduce the height of the cross-over ducts. In addition, since the lower cross-over duct supports the upper cross-over duct, it is not necessary to specially install a support assist member for the upper cross-over duct, which otherwise usually needs the support assist member for support from the lateral side thereof because of having a long straight pipe portion. Thus, material cost, construction cost, and other costs can be reduced.

Since the two cross-over ducts have a very simple structure, a difference in pressure between the inlet portion and the outlet portion in each of the upper and lower cross-over ducts can relatively simply and accurately estimated by using experimental expressions or the like. Accordingly, it is possible to adjust pressure losses of the upper and lower cross-over ducts into the same level and therefore to facilitate the total design.

The cross-over ducts can be installed so that their gravity center may be coincident with the center of the rotational axis of the turbine. Thus, a risk of turbine vibration due to the deviation of the gravity center resulting from thermal deformation is low.

The present embodiment described above can provide cross-over ducts that are configured to maintain strength and reliability at low cost while reducing a loss occurring therein.

The present invention relates to a cross-over duct of a steam turbine that is preferably reduces a pressure loss encountered at the time of causing steam discharged from an intermediate pressure turbine to flow in a low pressure turbine, and thereby contributing to an improvement in turbine thermal efficiency.

What is claimed is:

1. A steam turbine having a cross-over duct for delivering steam discharged from an intermediate pressure turbine to a low pressure turbine, wherein the intermediate pressure turbine provides two outlets for discharging exhaust steam, the low pressure turbine provides two inlets, said outlets and said inlets are arranged on the same straight line as viewed from a planar direction, one of said outlets and one of said inlets which are in close position each other are connected through a cross-over duct, the other of said outlets and the other of said inlets which are in far position each other are connected through another cross-over duct, and said cross-over ducts are arranged to be at two stages in the up-down direction.

2. The steam turbine according to claim 1, wherein said cross-over ducts are located just above the axis of the intermediate pressure turbine and lower pressure turbine.

3. The steam turbine according to claim 1, wherein said cross-over ducts are configured such that a cross-over duct located at a lower stage supports a cross-over duct located at an upper stage.

4. The steam turbine according to claim 1, wherein each of said cross-over ducts has a duct structure which is composed of a bent pipe and a straight pipe each of which does not have a branch portion or a merging portion.

5. The steam turbine according to claim 1, wherein each of said cross-over ducts includes a flat pipe in which a shape of cross-section perpendicular to an central axis of the pipe has two diameters which pass through the center of the cross-section, and are orthogonal to each other and different in length each other.

6. The steam turbine according to claim 5, wherein the cross-sectional shape of said flat duct of said cross-over duct is oval or rectangular.

* * * * *